US005174348A

United States Patent [19]

Miyamoto et al.

[11] Patent Number: 5,174,348

[45] Date of Patent: Dec. 29, 1992

[54] AUTOMATIC PLANNING MACHINE

[75] Inventors: Kouichi Miyamoto; Mitsumasa Sato; Tatsuya Wada, all of Tokyo, Japan

[73] Assignee: Ryobi Limited, Tokyo, Japan

[21] Appl. No.: 751,747

[22] Filed: Aug. 29, 1991

[30] Foreign Application Priority Data

Aug. 30, 1990 [JP] Japan ..... 2-229975

[51] Int. Cl.[5] ..... B27C 1/02

[52] U.S. Cl. ..... 144/117 R; 144/114 R; 144/246 R; 144/247; 144/249 R

[58] Field of Search ..... 198/624, 817, 836; 144/114 R, 117 R, 128, 129, 130, 131, 246 R, 246 D, 247, 249 R

[56] References Cited

U.S. PATENT DOCUMENTS

| | | | |
|---|---|---|---|
| 2,873,776 | 2/1959 | Buttke | 144/117 R |
| 3,718,168 | 2/1973 | Berends | 144/117 R |
| 4,031,932 | 6/1977 | Leasure | 144/117 R |
| 4,067,370 | 1/1978 | Chang | 144/117 R |
| 4,456,042 | 6/1984 | Clark et al. | 144/117 R |
| 4,886,099 | 12/1989 | de Abreu | 144/117 R |

*Primary Examiner*—W. Donald Bray
*Attorney, Agent, or Firm*—Brooks & Kushman

[57] ABSTRACT

An automatic planning machine has a vertical stationary stool functioning to cut a workpiece flatly and a vertical movable stool opposed to the stationary stool. The stationary stool has a plurality of feed rollers while the movable stool has a plurality of pressure rollers. A pressure force by the pressure rollers can be selectively changed over thereby to push the workpiece on the stationary stool at the time of flat work and to push the workpiece on the movable stool at the time of thickness determination work.

13 Claims, 19 Drawing Sheets

AUTOMATIC PLANNING MACHINE

BACKGROUND OF THE INVENTION

This invention relates to an automatic planing machine for cutting a work flatly and at a predetermined thickness, and more particularly to an automatic wood planing machine for cutting a wood workpiece.

In general, the automatic wood planing machine performs a flat work for cutting the surface of the workpiece flatly and a thickness determination work for cutting the wood workpiece so as to have a desired thickness. Such an automatic wood planing machine is disclosed in Japanese Patent Publication 30642/1982. Such a conventional automatic wood planing machine has a rotary cutter block with a blade which is disposed horizontally, a front and a rear tables, stools or bases disposed in front of the rotary cutter block and at the back thereof. The front and rear tables have some feed rollers therein for feeding the workpiece to be cut. A movable base is located, under the front and rear tables, movably toward and away from the front and rear tables. In the case of the flat work, the workpiece is fed along the upper surfaces of the front and rear tables while the lower surface of the workpiece is cut by the rotary cutter block. In the case of the thickness determination work, the workpiece is fed along the upper surface of the movable base with the upper surface of the workpiece contacting the feed rollers provided on the lower face of the front and rear tables. At this time, the upper surface of the workpiece is cut by the cutter block disposed horizontally between the front and rear tables.

In this conventional automatic wood planing machine, when the flat work is performed, the workpiece is fed by hand along the upper surface of the front and rear tables without any feed rollers in one direction, and when the thickness determination work is performed, the workpiece is automatically fed along the movable base in the direction reverse to that in the case of the flat work. This is because the upper portion of the cutter block is used in the case of the flat work while the lower portion of the cutter block is used in the case of the thickness determination work, and the cutter block is rotated only in one direction. Therefore, the machine cannot be constructed compact. Further, it is troublesome that the workpiece must be fed in the opposite directions during the flat and thickness determination work.

SUMMARY OF THE INVENTION

It is an object of this invention to provide an automatic planing machine which is constructed compact and which can perform both a flat work and a thickness determination work at the same cutting position by feeding a workpiece in one direction.

According to this invention, there is provided a planing machine for cutting a workpiece flatly and/or at a predetermined thickness, which comprises: a cutter block for cutting the workpiece; at least one flat work stool or table provided on a side of the cutter block for performing a flat work in which the workpiece is cut flatly; a thickness determination work stool or table provided opposite to the flat work stool at a predetermined interval for performing a thickness determination work in which the workpiece is cut so as to have a predetermined thickness, and pushing means disposed between the flat and thickness determination work stools for selectively pushing the workpiece on either the flat work stool or the thickness determination work stool.

Further objects, features and other aspects of this invention will be understood from the following detailed description of the preferred embodiments of this invention with reference to the drawings.

DETAILED DESCRIPTION OF THE INVENTION

Figure 1:
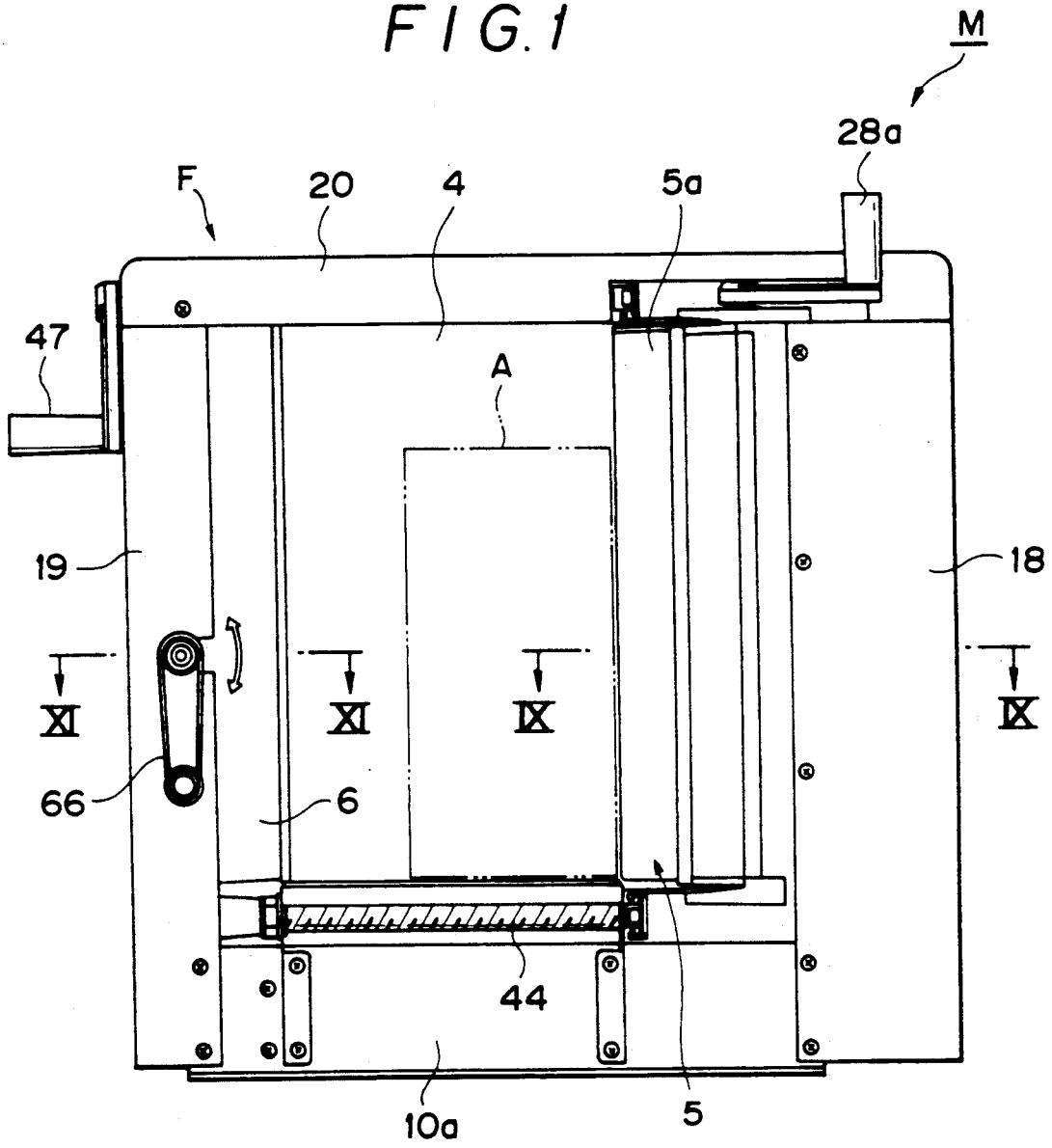
FIG. 1 is a front elevational view of an automatic planing machine according to one embodiment of this invention.
Figure 2:
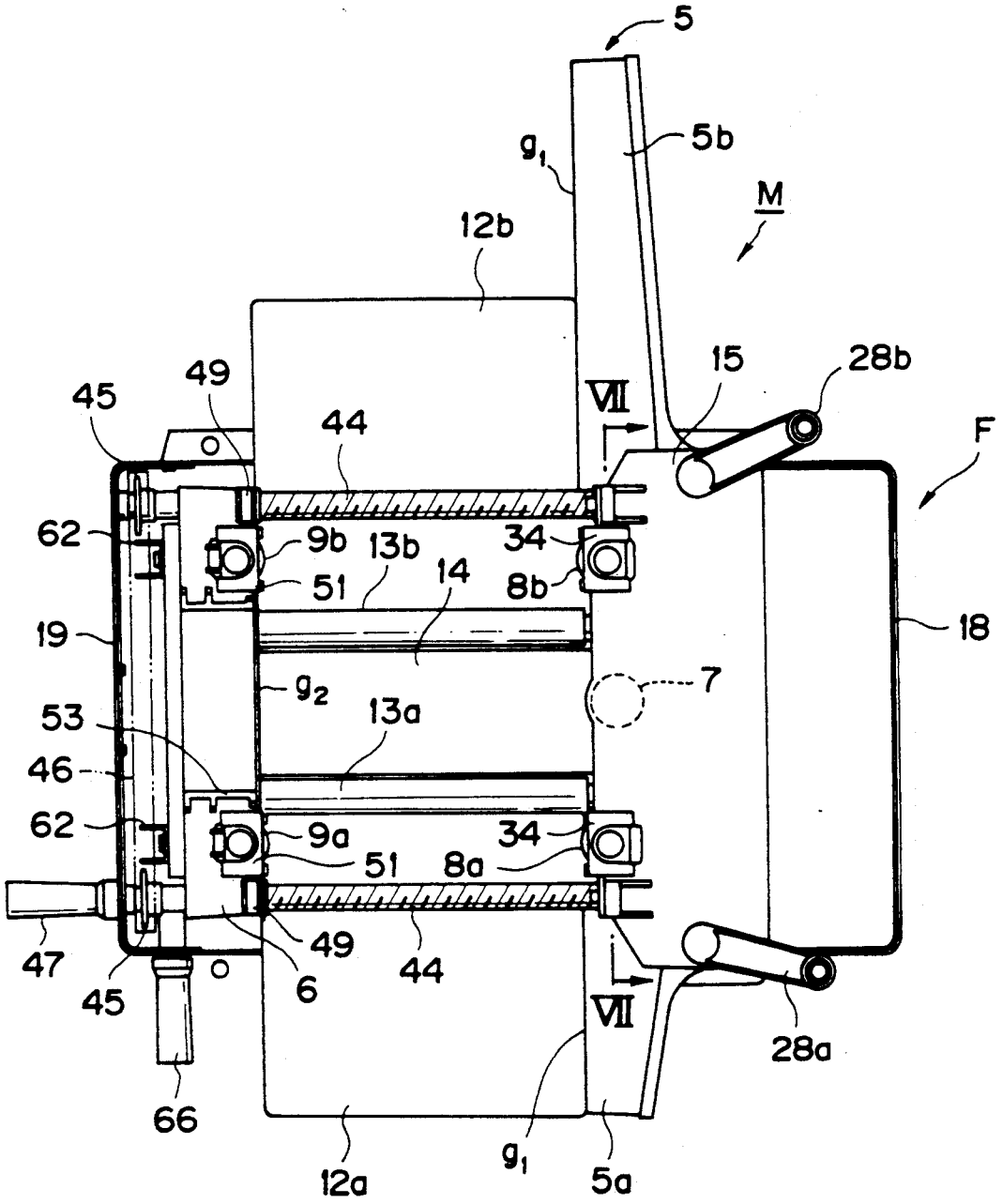
FIG. 2 is a plan view of the automatic planing machine with an upper cover being removed.
Figure 3:
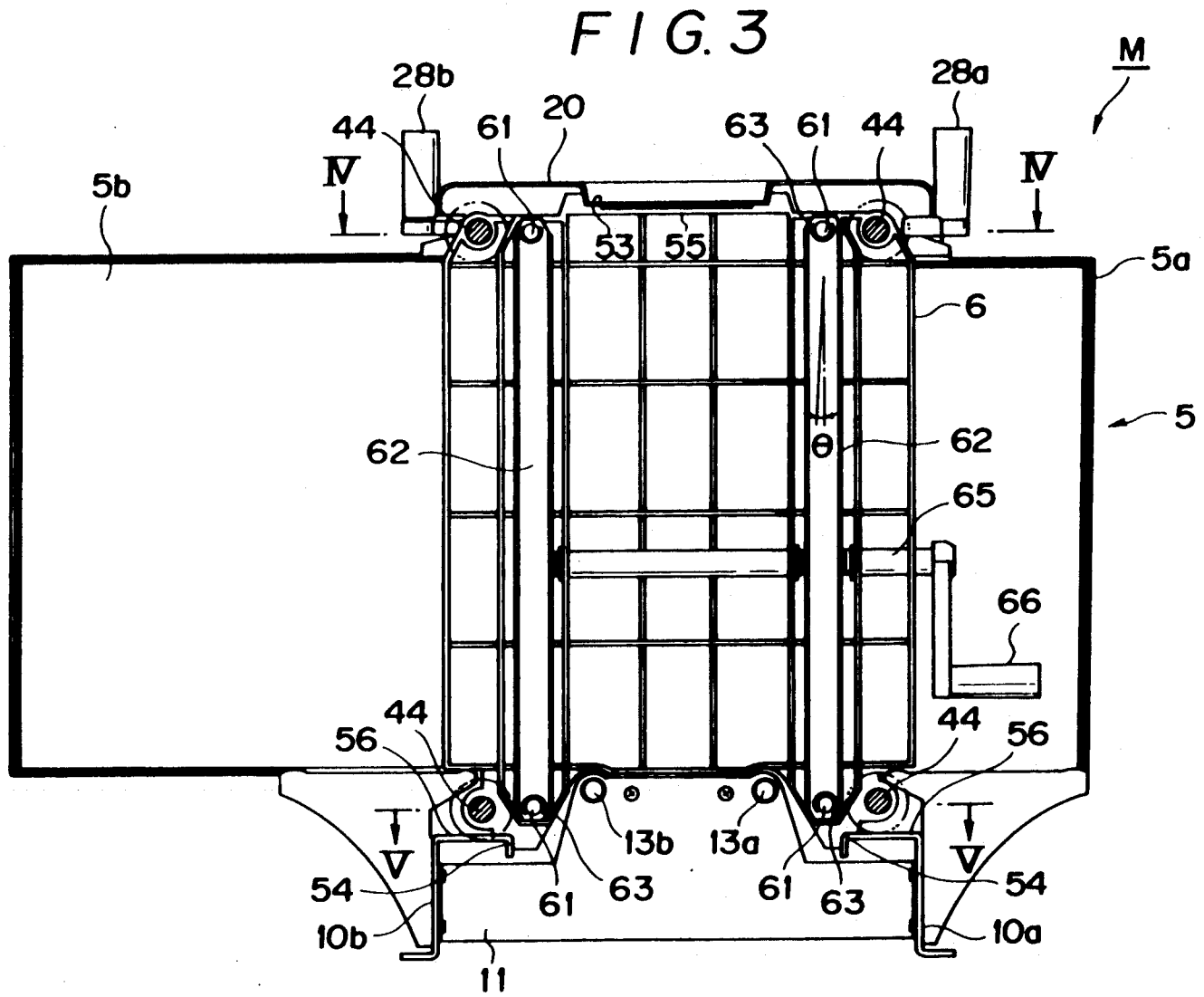
FIG. 3 is a left side view of the automatic planing machine with a left cover being removed.

In FIGS. 1 to 3, an automatic planing machine M has, at the center portion thereof, a passing hole 4 through which a wood workpiece A to be cut passes in the front and rear direction of the machine M. The machine M has a frame F whose right upright portion is provided with a stationary stool or table 5 which is used for a flat work of the workpiece A, that is, for cutting the workpiece A flatly and whose left portion is provided with a movable stool or table 6 which is opposed to the stationary stool 5 to be used for a thickness determination work of the workpiece A, that is, for cutting the workpiece A so as to have a predetemined thickness.

At the center portion of the stationary stool 5 is disposed vertically a cutter block 7 for cutting the workpiece A, and at the front and rear positions of the cutter block 7 are disposed a pair of feed rollers 8*a*, 8*b* for feeding the workpiece A in the front and rear direction. In contrast, the movable stool 6 has a pair of pressure rollers 9*a*, 9*b* opposed to the feed rollers 8*a*, 8*b* for cooperating with the feed rollers 8*a*, 8*b* to hold the workpiece A therebetween, and an urging or pushing device P for urging the pressure rollers 9*a*, 9*b* toward the feed rollers 8*a*, 8*b*.

Further, the lower portion of the frame F has a feed mechanism for moving the movable stool 6 toward and away from the stationary stool 5 and a drive mechanism for rotating the cutter block 7 or the like.

Each portion of the machine M will now be explained in more detail.

Frame

The frame F has a substantially rectangular hollow body which is laid down and which is provided with the passing hole 4 for the workpiece A at its center position as described above, and has, at its lower portion, a front base 10*a* and a rear base 10*b* (FIG. 3) which are connected with each other by a bracket 11 extending in the front and rear direction. The front and rear bases 10*a*, 10*b* are provided with two horizontal support plates 12*a*, 12*b* for supporting the workpiece A, respectively, and a pair of feed rollers 13*a*, 13*b* and a receptacle table 14 are bridged between the left and right brackets 11, 11, respectively.

Figure 9:
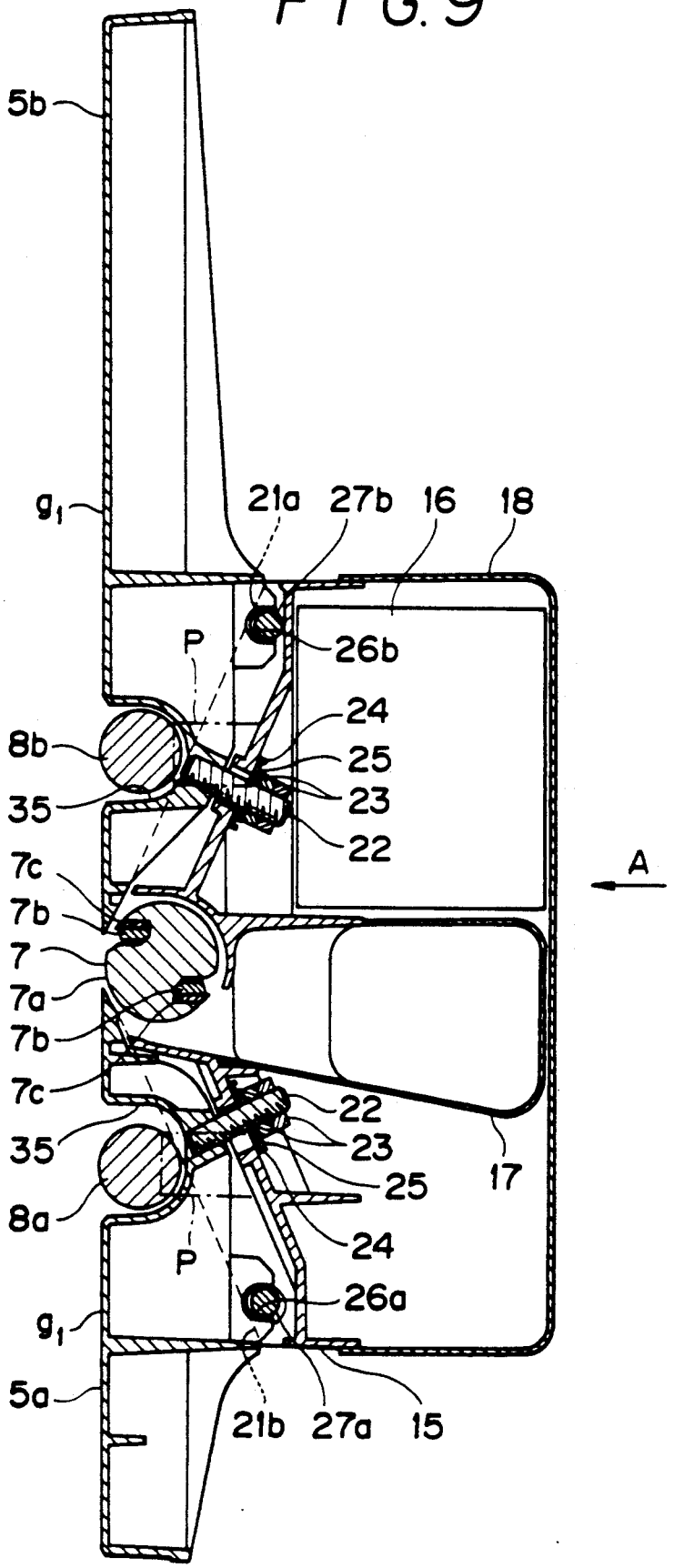
FIG. 9 is a view as viewed along the line IX—IX in FIG. 1.
Figure 10:
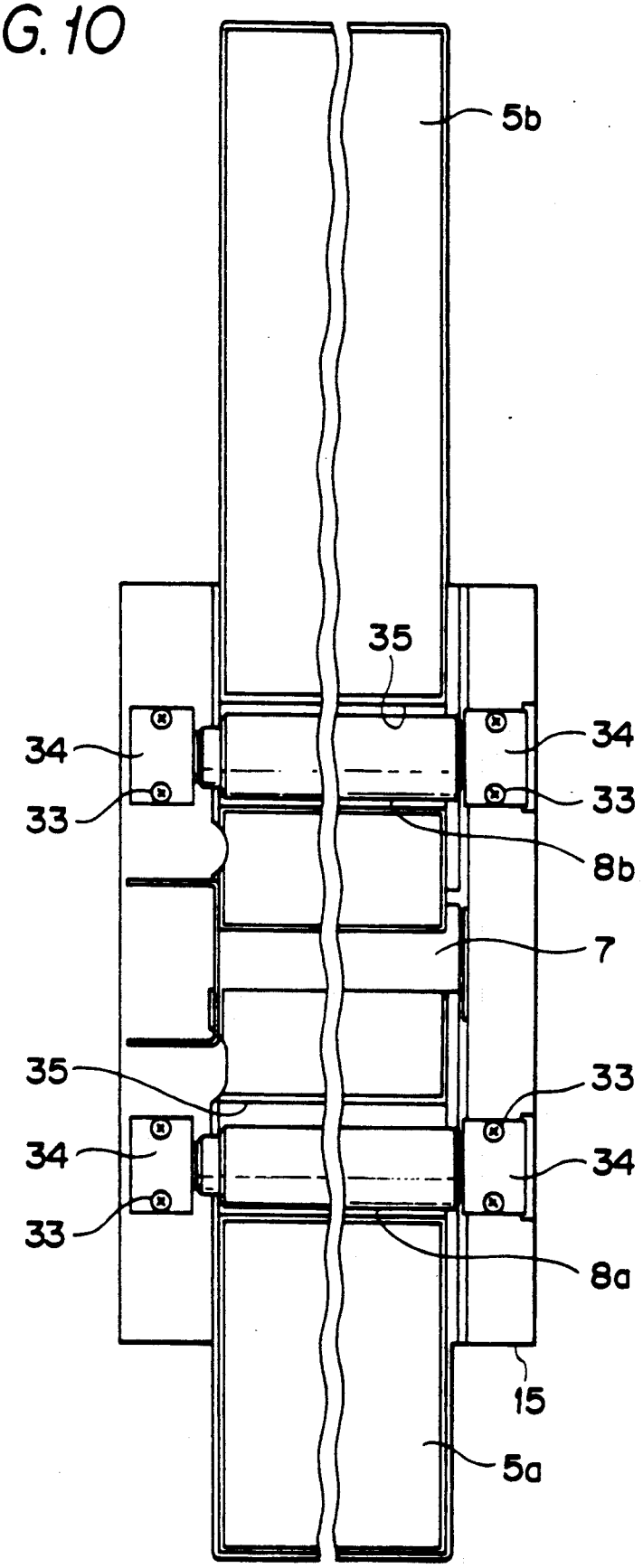
FIG. 10 is a view as viewed along an arrow A in FIG. 9.

The right upright portion has, as shown in FIGS. 9 and 10, a casing 15 for supporting the cutter block 7 and the feed rollers 8*a*, 8*b*. The casing 15 is fixed by a plurality of bolts to the front and rear bases 10*a*, 10*b*, and has, at its center position facing the passing hole 4, an accommodating chamber for the cutter block 7. Moreover, the casing 15 has, on its right side as viewed in FIG. 9, a motor for driving the cutter block 7 or the like, a dust cover 17 for receiving chips generated by the cutter block 7, etc. A right cover 18 is connected to the casing 15 in order to cover those members therewith.

As shown in FIG. 2, the left upright portion comprises a left cover 19 detachably connected to the front and rear bases 10*a*, 10*b*. The upper parts of the left and right upright portions are connected to each other through an upper cover 20 forming an upper portion of the frame F (FIGS. 1 and 3).

Stationary Stool

To the front and rear portions of the casing 15 of the right upright portion is, as shown in FIGS. 1, 2, 3, 9 and 10, fixed a front stool 5*a* and a rear stool 5*b*, which form the stationary stool 5 for performing the flat work. The front and rear stools 5*a*, 5*b* are adjustably moved in the front and rear directions, and have two inclined surfaces inclining at a predetermined angle with respect to the front and rear direction, respectively. The front and rear stools 5*a*, 5*b* abut against the casing 15 at the inclined surfaces 21*a*, 21*b*, and are held on the casing 15 by means of stud bolts 22, nuts 23, slippery plates 24 and washers 25. The front and rear stools 5*a*, 5*b* has, at their portions opposed to the casing 15, two U-shaped grooves 26*a*, 26*b* for receiving two eccentric shafts 27*a*, 27*b* which are rotated by two handles 28*a*, 28*b* (FIGS. 1 and 3), respectively. The handles 28*a*, 28*b* are supported rotatably on the casing 15. The rotation of the handles 28*a*, 28*b* causes the eccentric shafts 27*a*, 27*b* to rotate in the U-shaped grooves 26*a*, 26*b* thereby to move the front and rear stools 5*a*, 5*b* along the inclined surfaces 21*a*, 21*b*. As a result, a cutting amount by the cutter block 7 can be adjusted.

Cutter Block, Feed Roller and Driving Mechanism Therefor

Figure 4:
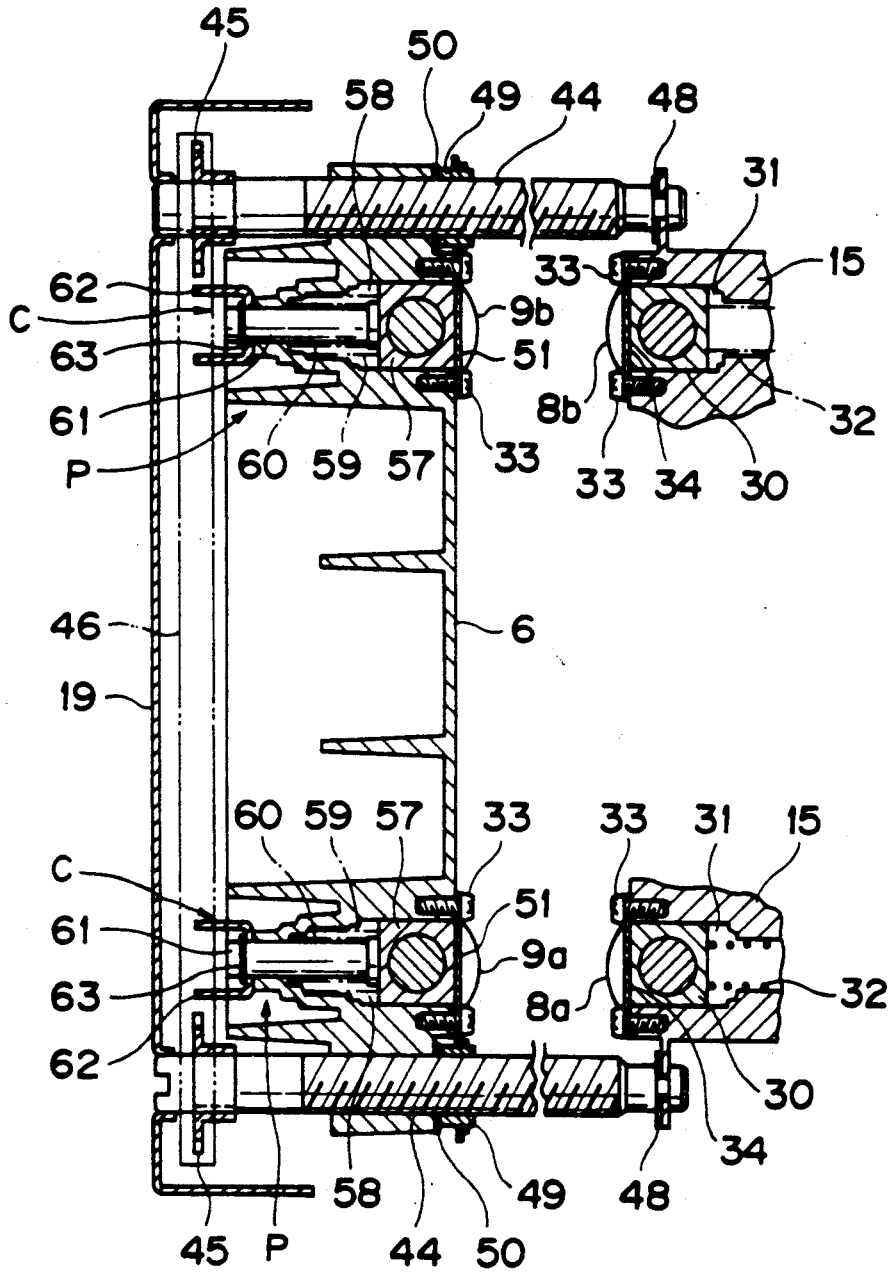
FIG. 4 is a view as viewed along the line IV—IV in FIG. 3.
Figure 5:
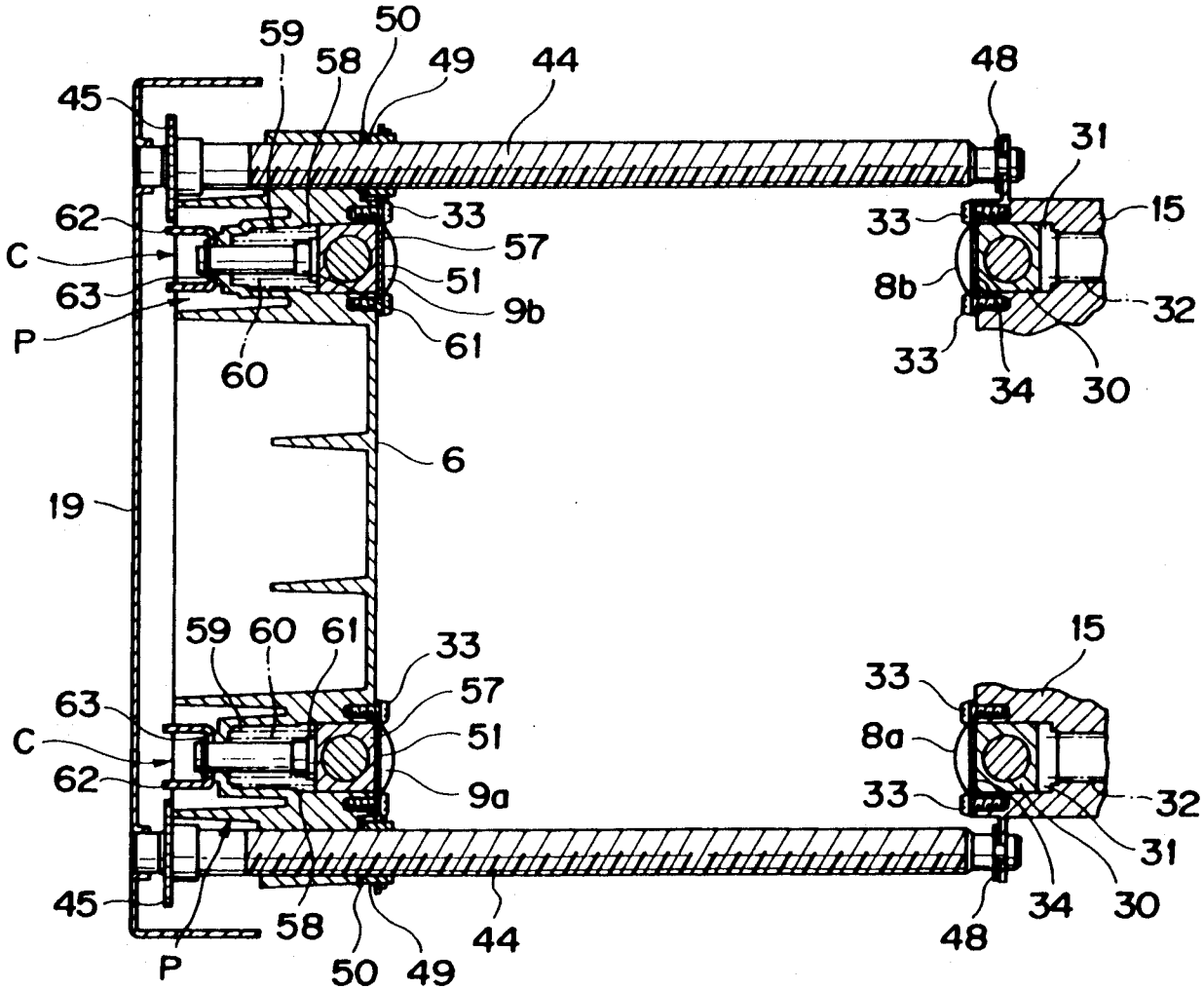
FIG. 5 is a view as viewed along the line in FIG. 3.
Figure 7:
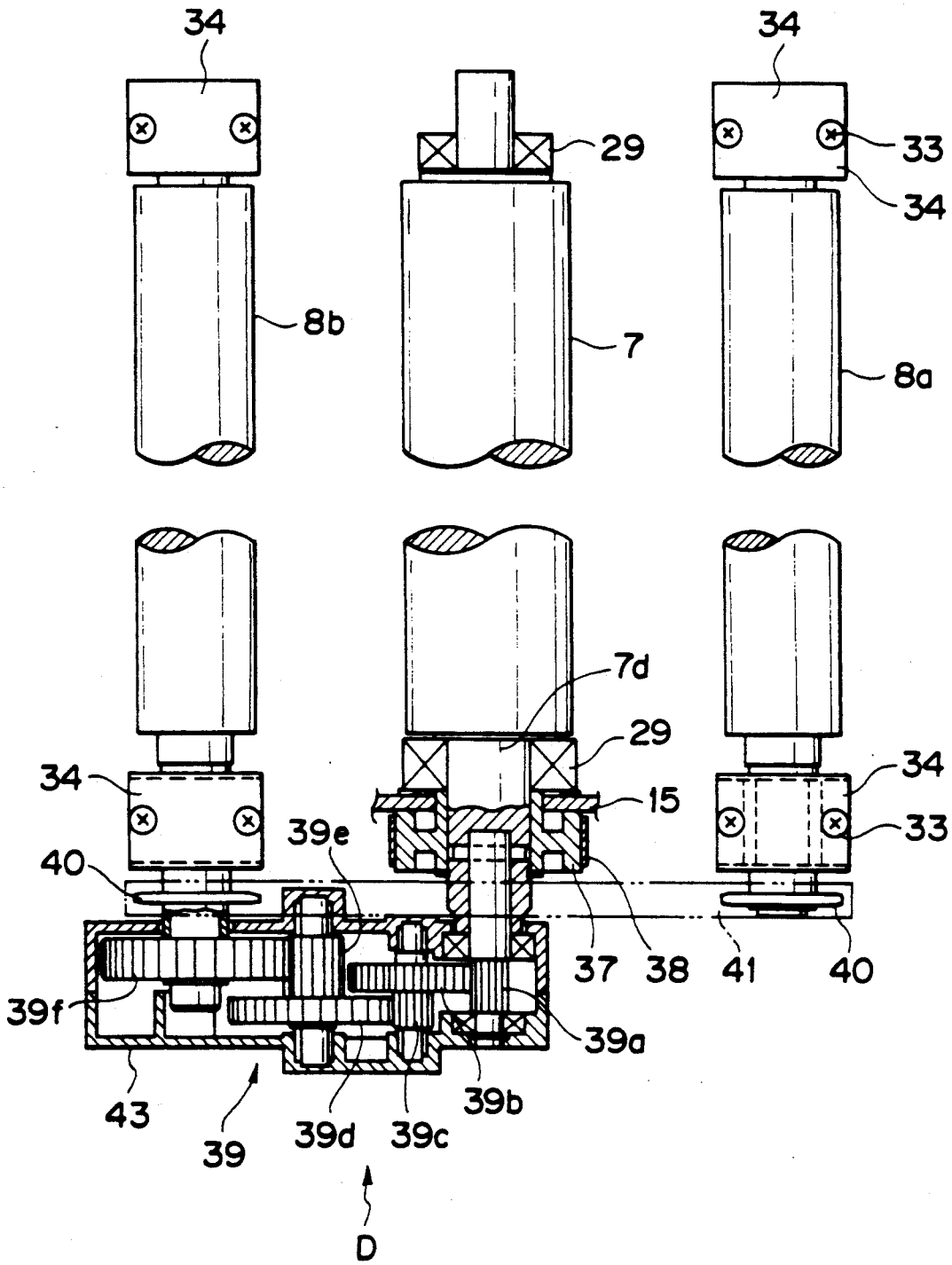
FIG. 7 is a view as viewed along the line VII—VII in FIG. 2, showing a driving mechanism for a cutter block of the automatic planing machine.

The cutter block 7 is disposed vertically to cut the workpiece A passing through the passing hole 4 of the frame F and is supported rotatably on the casing 15 through a plurality of bearings (FIG. 7). The cutter block 7 is, as shown in FIG. 9, provided with a columnar block body 7*a* and two blades 7*c*, 7*c*, fitted detachably in the block body 7*a* by two cutter holding members 7*b*, 7*b*. The two feed rollers 8*a*, 8*b* are disposed vertically and parallel to the center axis of the cutter block 7 at the front and rear positions of the cutter block 7, respectively. The two feed rollers 8*a*, 8*b* are, as shown in FIGS. 4 and 5, fitted to the casing 15 of the frame F through a plurality of rectangular or square metal bearings 30, respectively. Each metal bearing 30 is inserted into each of rectangular holes 31 formed horizontally in the casing 15 and is pushed, on a holding plate 34 which is fixed by a plurality of screws 33 to the casing 15 to close the rectangular hole 31, from back by a compression coil spring 32. This structure causes the feed rollers 8*a*, 8*b* to be elastically held on the frame F, and, therefore, the feed rollers 8*a*, 8*b* contact the surface of the workpiece A with a proper constant pressure force. The rectangular metal bearings 30 are located in the upper and lower portions of the casing 15 where the workpiece A does not contact the bearings 30 when the workpiece A passes through the hole 4. That is, the metal bearings do not obstruct passing of the workpiece A. The intermediate portions of the feed rollers 8*a*, 8*b* are, as shown in FIGS. 9 and 10, accommodated in two recesses 35, 35 formed in the front and rear stools 5*a*, 5*b*, respectively.

Figure 8:
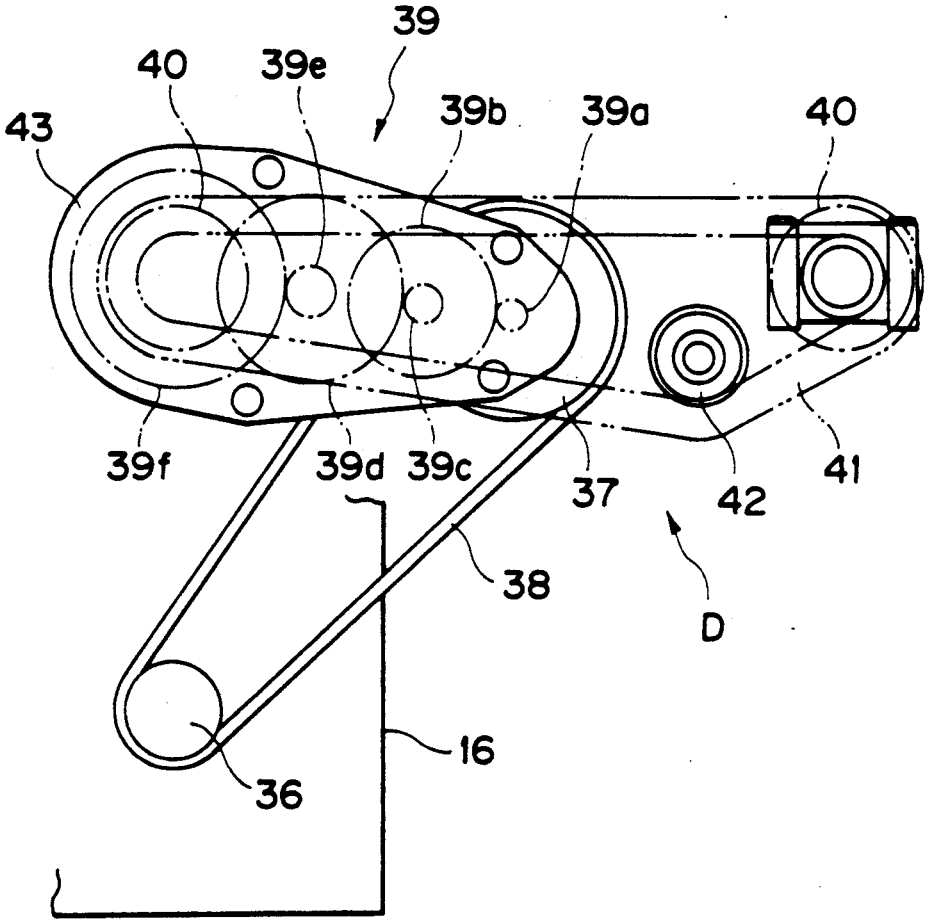
FIG. 8 is a bottom view of the driving mechanism, shown in FIG. 7, of the automatic planing machine.

The cutter block 7 and the feed rollers 8*a*, 8*b* are rotated by a driving mechanism D shown in FIGS. 7 and 8. The driving mechanism D comprises a small pulley 36 fixed to the output axis of the motor 16, a large pulley 37 fixed to the lower end of the shaft 7*d* of the cutter block 7, an endless belt 38 disposed between the two pulleys 36, 37, a reduction gear train 39 for transmitting the rotation of the shaft 7*d* of the cutter block 7 to one of the feed rollers 8*a*, 8*b*, two sprockets 40, 40 fixed to the axes of the feed rollers 8*a*, 8*b*, respectively, a chain 41 disposed between the two sprockets 40, 40 for transmitting the rotation of one of the feed rollers 8*a*, 8*b* to the other of the feed rollers 8*a*, 8*b*, and a tension roller 42 for adjusting the tension of the chain 41. The reduction gear train 39 comprises three small gears 39*a*, 39*b*, 39*c* and three large gears 39*b*, 39*d*, 39*f* which are meshed alternately with each other in order to decrease the cutting rotational number of the cutter block 7 to the workpiece feeding rotational number thereby to rotate the feed rollers 8*a*, 8*b* with a decreased rotational number. The reduction gear train 39 is covered with a gear case 43, and the gear train 39 and the gear case 43 are accommodated in the lower portion of the frame F. Both of the sprockets 40 fixed to the axes of the two feed rollers 8*a*, 8*b* have the same number of tooth, and are rotated at the same rotational number as each other in the same direction.

Movable Stool and Feed Mechanism Therefor

The movable stool 6 holds the workpiece A together with the stationary stool 5, and is disposed vertically on the left side of the frame F. The four corners of the movable stool 6 are engaged with four horizontal feed screws 44 as shown in FIGS. 2, 3, 4 and 5. Each of the feed screws 44 is supported rotatably between the left cover 19 and the casing 15, and the left end of the feed screw 44 is extended into the left cover 19 to hold a sprocket 45 at its distal end. As shown in FIG. 4, an endless chain 46 is disposed between the four sprockets 45, and one of the feed screws 44 is connected to a handle 47 for rotating it (FIG. 1). When the handle 47 is rotated, all feed screws 44 are rotated in the same direction to move the movable stool 6 toward and away from the stationary stool 5. The movable stool 6 is used for determining the thickness of the workpiece A to be cut, that is, for finishing the workpiece A so as to have a predetermined thickness. Therefore, a back-lash of each feed screw 44 must be removed to move the movable stool 6 smoothly or without a play. Therefore, the following construction is adopted.

That is, as shown in FIGS. 4 and 5, a ring-like plate spring 48 is disposed between the casing 15 of the frame F and the right distal end of each feed screw 44 in order to remove a back-lash of each feed screw 44. Further, a nut 49 and a ring-like plate spring 50 are disposed between the movable stool 6 and a portion close to the left end of each feed screw 44 for the same purpose. The nut 49 is engaged with a rectangular hole 52 formed in a holding plate 51 mentioned after which is fixed to the movable stool 6 so as not to be rotated about the feed screw 44. Each of plate springs 48, 50 is made of elastic material having a ring-like shape with a cut away portion therein whose opposed portions are deformed in the opposite directions along the center axis of each plate spring. The plate spring 50 may be removed so that each nut 49 contacts directly the guide surface of the movable stool 6. This structure ensures that the movable stool 6 is always moved smoothly and the feeding length of the movable stool 6 can be reliably adjusted to increase accuracy of finishing.

In order to feed the movable stool 6 smoothly by an accurate length, the following structure is further adopted.

That is, as shown in FIGS. 2 and 3, the movable stool 6 has a guide recess 53 at the center of upper portion thereof, and two guide recesses 54, 54 at the front and rear ports of the lower portion thereof, respectively. The three recesses 53, 54, 54 are engaged with three rail portions 55, 56, 56 extending in the upper cover 20 of the frame F and the front and rear bases 10*a*, 10*b*, respectively. Therefore, the movable stool 6 can be smoothly moved along the rail portions 55, 56, 57 in the left and right directions. Instead of the above structure, a plurality of guide recesses may be provided on the frame F while a plurality of projected portions engaged with the guide recesses may be provided on the movable stool 6.

Pressure Roller and Pushing Device

Figure 6:
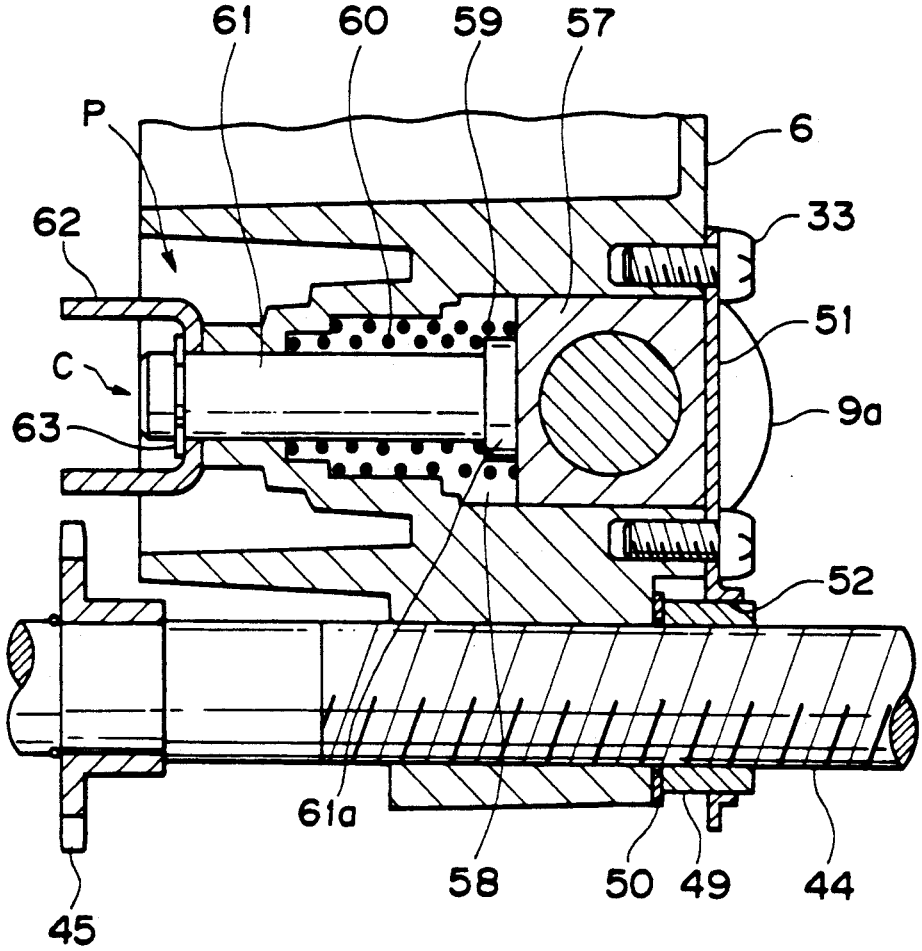
FIG. 6 is a horizontal sectional view with a partially cut away portion, showing a pushing device for pushing a pressure roller in the automatic planing machine.

Each of the pressure rollers 9*a*, 9*b* is provided on the movable stool 6 through the pushing device P. The pushing device P can selectively push each of pressure rollers 9*a*, 9*b* with two kinds of pressure forces, one of which is a pressure force for the flat work or finishing for the workpiece A to be cut and the other of which is a pressure force which is a pressure force for finishing or cutting the workpiece A so as to have a predetermined thickness. The former pressure force is larger than a constant force given by the feed rollers 8*a*, 8*b*, and the latter pressure force is smaller than the constant force given by the feed rollers 8*a*, 8*b*. The end of the axis of each of the pressure rollers 9*a*, 9*b* is, as shown in FIGS. 4 to 6, engaged with a rectangular metal bearing 57 which is inserted into a rectangular hole 58 formed horizontally in the movable stool 6. The rectangular metal bearing 57 is urged by a first compression coil spring 59 from back toward inside of the frame F to be pushed on the holding plate 51 which is fixed by a plurality of screws 33 to the movable stool 6 to close the rectangular hole 58. The first compression coil spring 59 generates a thickness determinating pressure force on each of the pressure rollers 9*a*, 9*b*, and the thickness determinating pressure is smaller than a pressure force given by the compression coil spring 32 of each of the feed rollers 8*a*, 8*b*. In the rectangular hole 58 is also provided a second compression coil spring 60 which pushes selectively the rectangular metal bearing 57 together with the first compression coil spring 59. The second compression coil spring 60 generates a flat work pressure force so as to add a certain pressure force to the pressure force by the first compression coil spring 59. The flat work pressure force is larger than a pressure force generated by the compression coil spring 32 of each of the feed rollers 8*a*, 8*b*. The compression force by the second compression coil spring 60 is selectively exerted on each of the pressure rollers 9*a*, 9*b* through a change-over mechanism C which comprises a pushing pin 61 for pushing the rectangular metal bearing 57.

The pushing pin 61 is provided inside the second compression coil spring 60 whose front end abuts against the flange 61*a* of the pushing pin 61. Two pushing pins 61, 61 disposed at two vertically separate positions of the movable stool 6 are connected to each other via an adjusting plate 62, corresponding to an adjusting plate 122 shown in FIG. 12, which is provided in parallel to the pressure rollers 9*a*, 9*b* and which is connected to the tail portion of the pushing pin 61 via a stop ring 63. Each adjusting plate 62 abuts against a cam 64, shown in FIG. 11, which is provided on the side of the compression coil springs 59, 60. Two cams 64 are supported on the opposite portions of an operating bar 65 which is pivotably provided on the movable stool 6 and is rotated by a handle 66 fixed to one end of the operating bar 65. The rotation of the handle 66 causes the rotation of the cams 64 to move each adjusting plate 62 in the left and right directions thereby to move the pushing pin 61 toward and away from the rectangular metal bearing 57 while expanding and shrinking the second compression coil spring 60. When the flange 61*a* of the pushing pin 61 contacts the rectangular metal bearing 57, each pressure roller is pushed toward the stationary stool 5 by a total force of the first and second compression coil springs 59, 60. In this case, a pressure force by the two pressure rollers 9*a*, 9*b* for pushing the workpiece A toward the two feed rollers 8*a*, 8*b* exceeds a pressure force by the feed rollers 8*a*, 8*b*. Therefore, the feed rollers 8*a*, 8*b* are retracted into the stationary stool 5 to cause the workpiece A to contact the front and rear stationary stools 5*a*, 5*b*.

In contrast, if the cams 64 are rotated so that the adjusting plates 62 pull each pushing pin 61 backward or leftward to shrink the second compression coil springs 60 thereby to separate the flanges 61*a* from the rectangular metal bearings 57. At this time, the pressure rollers 9*a*, 9*b* are pushed toward the feed rollers 8*a*, 8*b* by only the first compression springs 54. Therefore, a pressure force of the pressure rollers 9*a*, 9*b* for pushing the workpiece A toward the feed rollers 8*a*, 8*b* becomes smaller than a pressure force of the feed rollers 8*a*, 8*b*. As a result, the pressure rollers 9*a*, 9*b* are retracted into the movable stool 6, so that the workpiece A contacts the guide surface $g_2$ (FIG. 2) of the movable stool 6.

As shown in FIG. 3, the pressure rollers 9*a*, 9*b* and the feed rollers 8*a*, 8*b* are disposed obliquely at a certain angle $\theta$ with respect to a lower datum plane formed on the lower portion of the frame F in order to push the workpiece A downwardly on the lower datum plane. Only one pressure roller 9*a* and one feed roller 8*a* which are respectively provided on the inlet side of workpiece passing hole 4 may be disposed obliquely with another pressure roller 9*b* and feed roller 8*b* being disposed vertically.

The operation of the above automatic planing machine will now be explained.

Operation for Flat Work

First, the handles 28*a*, 28*b* (FIG. 3) are rotated to adjust the positions of the front and rear stationary stools 5*a*, 5*b*. In addition, the handle 66 shown in FIG. 2 is rotated to exert the pressure force of the second compression coil springs 60 on the rectangular metal bearings 57. Further, the handle 47 shown in FIG. 2 is rotated to move the movable stool 6 in accordance with the thickness of the workpiece A.

The motor 16 is then started to rotate the feed rollers 8*a*, 8*b* and the cutter block 7 with a predetermined rotational number, and, thereafter, the workpiece A is fed into the passing hole 4 in the frame F. The workpiece A is automatically fed from the front of the machine to the back thereof under a frictional force generated between the surface of the workpiece and the feed rollers 8*a*, 8*b*.

At this time, the pressure rollers 9*a*, 9*b* push the workpiece A toward the stationary stool 5 under a pressure force larger than a pressure force of the feed rollers 8*a*, 8*b*, so that the workpiece A is cut by the cutter block 7 while contacting the guide surfaces $g_1$ of the stationary stool 5. In this manner, a flat work for cutting flatly the surface of the workpiece A is carried out.

Operation for Thickness Determination Work

The adjustments of the front and rear stationary stools 5*a*, 5*b* and the movable stool 6 are performed in the same manner as in the case of the operation for the flat work, and, however, the pushing devices P are operated in a manner reverse to that of the flat work. That is, the cams 64 are rotated so as to separate the pushing pins 61 from the rectangular metal bearings 57 to release a pressure force of the second compression springs 60 from the rectangular metal bearings 57. As a result, the pressure force by the pressure rollers 9*a*, 9*b* to push the pressure rollers 9*a*, 9*b* on the guide surface $g_2$ of the movable stool 6. Therefore, the workpiece A is fed forwardly while contacting the guide surface $g_2$ of the movable stool 6, and the surface of the workpiece A on the side of the stationary stool 5 is cut by the cutter block 7.

Next, other embodiments of this invention will be explained.

First, a change-over mechanism C for changing a pressure force of the pressure rollers 9*a*, 9*b* may be constructed as shown in FIGS. 12 to 15.

Figure 12:
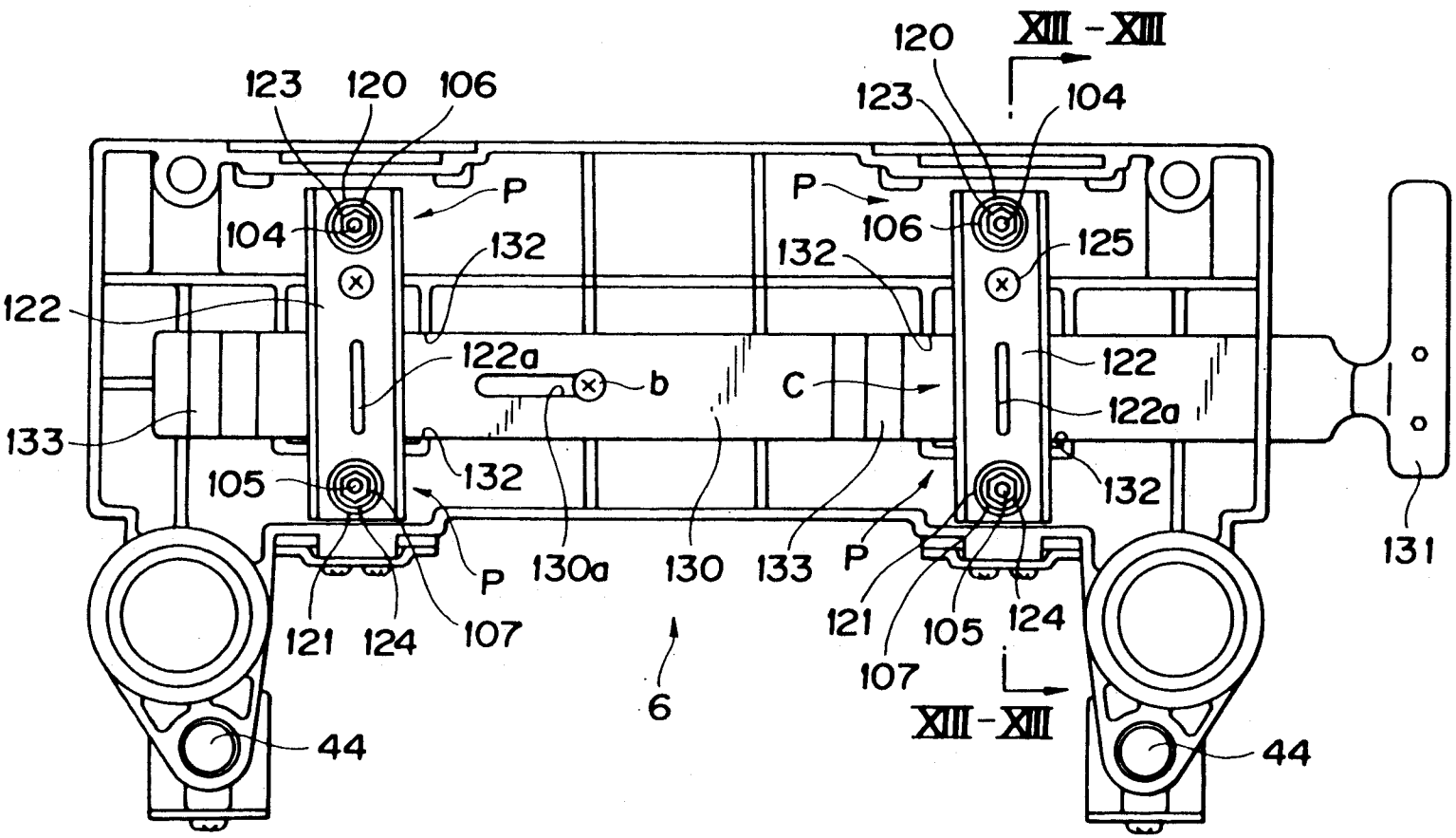
FIG. 12 is a front elevational view of a movable stool; showing a change-over mechanism according to this invention.
Figure 13:
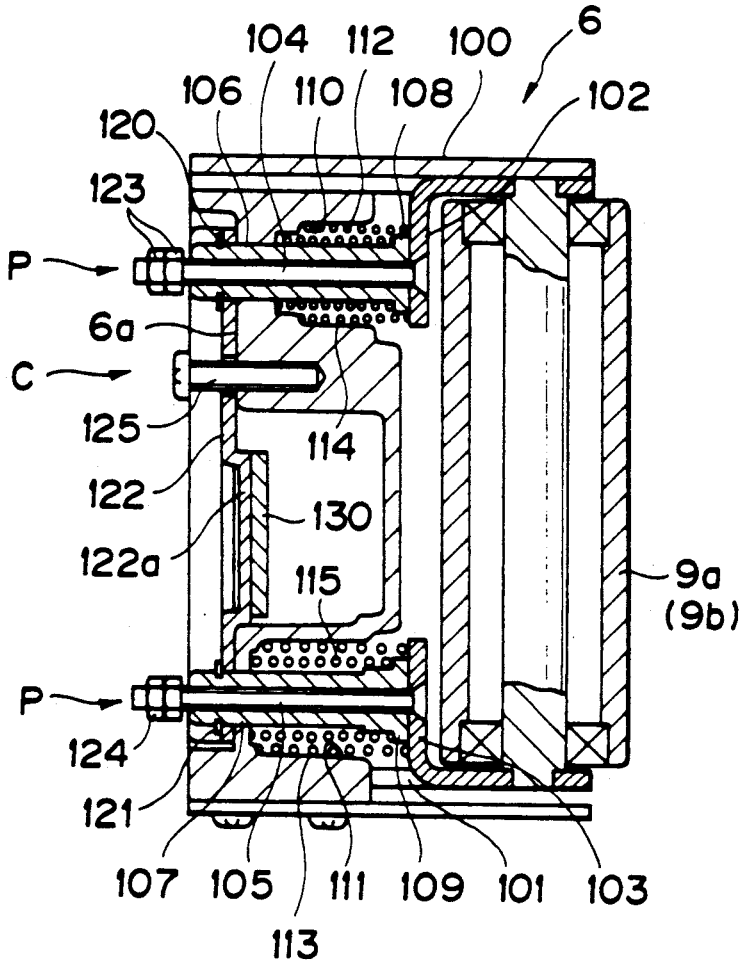
FIG. 13 is a sectional view taken along the line XIII—XIII in FIG. 12, at the time of a flat work.
Figure 14:
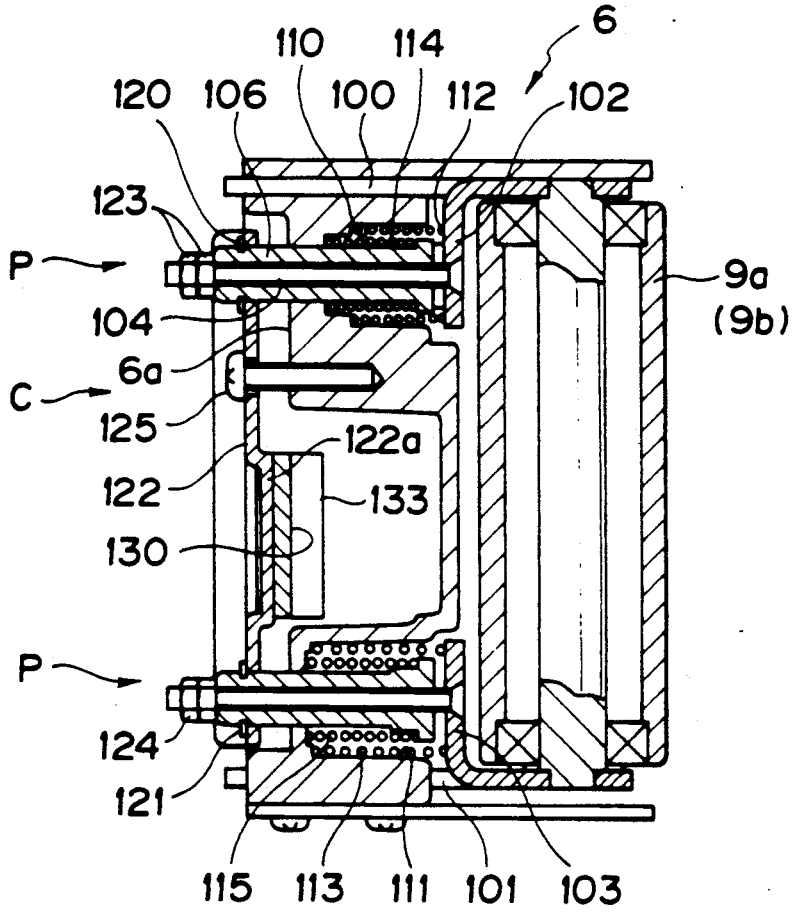
FIG. 14 is a sectional view taken along the line XIII—XIII in FIG. 12, at the time of a thickness determination work.

In FIGS. 12 to 14, the upper and lower portions of the movable stool 6 have an upper and a lower supporting plates 100, 101 for supporting rotatably the pressure rollers 9*a*, 9*b*. Each of the upper and lower supporting plates 100, 101 has each of bent portions 102, 103 extending toward the center portion of the movable stool 6 in the vertical direction of the movable stool 6, respectively. Each of the bent portions 102, 103 holds the head of each of pushing rods 104, 105 by which each of pushing sleeves 106, 107 is slidably supported. The pushing sleeves 106, 107 have, at their front ends, two flanges 108, 109, respectively. The pushing sleeves 106, 107 extend, in the left and right direction, through two cylindrical holes 110, 111 formed in the upper and lower portions of the movable stool 6, respectively, and two first compression coil springs 112, 113 are provided in the cylindrical holes 110, 111 whose front ends abut against the bent portions 102, 103, respectively, and whose rear ends abut against the bottom walls of the cylindrical holes 110, 111, respectively. In contrast, inside the first compression coil springs 112, 113 and outside the pushing sleeves 106, 107 are respectively disposed two second compression coil springs 114, 115 whose front ends abut against two flanges 108, 109 formed on the front ends of the pushing sleeves 106, 107 and whose rear ends abut against the bottom walls of the cylindrical holes 110, 111, respectively.

The rear ends of the pushing sleeves 106, 107 are connected to an adjusting plate 122 through two stop rings 120, 121, respectively, and the adjusting plate 122 connect the two pushing sleeves 106, 107 to each other.

The rear ends of the pushing sleeves 106, 107 have two double nuts 123, 124 which are disposed at a predetermined interval separated from the rear ends of the pushing sleeves 106, 107. At a position under the pushing rod 104 is provided a guide bolt 125 which guides the left and right movement of the adjusting plate 122 and adjustably restricts the range of the left movement, as viewed in FIG. 13, of the adjusting plate 122.

At the center position of the movable stool 6 in its vertical direction is provided an operating plate 130, for operating the pushing devices P, which is slidable within a predetermined range in the left and right directions. The operating plate 130 has a handle 131 at its one end projected from the movable stool 6 in the right direction as viewed in FIG. 12. The operating plate 130 is moved along a guide portion of the frame F in the left and right directions, as viewed in FIG. 12, while being guided by a slit 130*a* formed on the operating plate 130 and a bolt fixed to the frame of the movable stool 6 and engaged with the slit 130*a*. The operating plate 130 has, as shown in FIGS. 12 and 14, two operating raised portions 133, 133 at predetermined positions corresponding to the two adjusting plates 122, 122, respectively. When the raised portions 133, 133 abut against two projections 122*a*, 122*a* formed at the center portions of the two adjusting plates 122, 122, the adjusting plates 122, 122 are moved outwardly of the movable stool 6 to retract slightly the pressure rollers 9*a*, 9*b* inside the movable stool 6 thereby to change over a pressure force for pressing the pressure rollers 9*a*, 9*b* by the first and second compression coil springs (FIG. 14).

Figure 15:
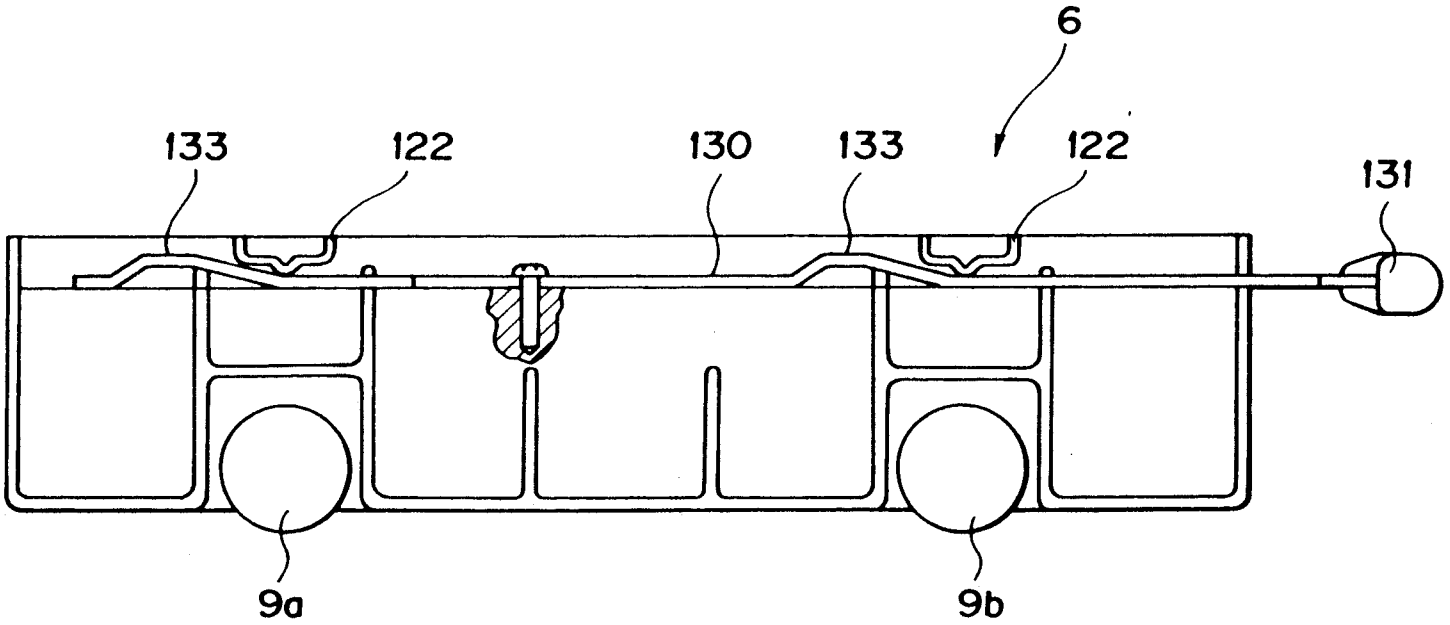
FIG. 15 is a plan view of a movable stool shown in FIG. 12.

In the case of the flat work, as shown in FIGS. 12, 13 and 15, the projections 122*a*, 122*a* of the adjusting plates 122, 122 are deviated from the operating raised portions 133, 133. At this time, the adjusting plates 122 abut against the outer walls 6a of the movable stool 6 and a compression force by the first and second compression coil springs 112, 113, . . . 115 is exerted on the pressure rollers 9a, 9b. As a result, the pressure rollers 9a, 9b are projected toward the workpiece A to be cut to push the workpiece A on the stationary stool 5. Since the total pressure force by the first and second compression coil springs 112, 113, . . . 115 exceeds the pressure force by the compression coil springs 32, the feed rollers 8a, 8b are retracted into the stationary stool 5. The flat work is thus performed.

In the case of thickness determination work, in FIG. 12, an operator holds the handle 131 to move the operating plate 130 to the right thereby to cause the operating raised portions 133 and the projections 122a of the adjusting plates 122 to register with each other. At this time, as shown in FIG. 14, the adjusting plates 122 are moved to the left, so that the pushing sleeves 106, 107 slide on the pushing rods 104, 105 to the left, and the rear ends of the pushing sleeves 106, 107 abut against the double nuts 123, 124. Therefore, the pushing sleeves 106, 107 are separated from the bent portions 102, 103 while shrinking the second compression coil springs 114, 115. The adjusting plates 122 are moved further to the left to shrink both first and second compression coil springs 112, 113, . . . 115 thereby to move the roller supporting plates 100, 101 to the left so as to retract slightly the pressure rollers 9a, 9b into the movable stool 6. When the adjusting plates 122 abut against the heads of the guide bolt 125, the leftward movement of the adjusting plates 122 is stopped. At this time, the pressure rollers 9a, 9b are slightly retracted from the state of the flat work into the movable stool 6, and only the pressure force by the first compression coil springs 112, 113 is exerted on the pressure rollers 9a, 9b. Since a spring force of each first compression coil spring is determined smaller than a spring force of each compression coil spring of the feed rollers 8a, 8b, the pressure rollers 9a, 9b are pushed by the workpiece A to be cut to be retracted inside the surface of the movable stool 6 functioning to determine the thickness of the workpiece A.

Figure 11:
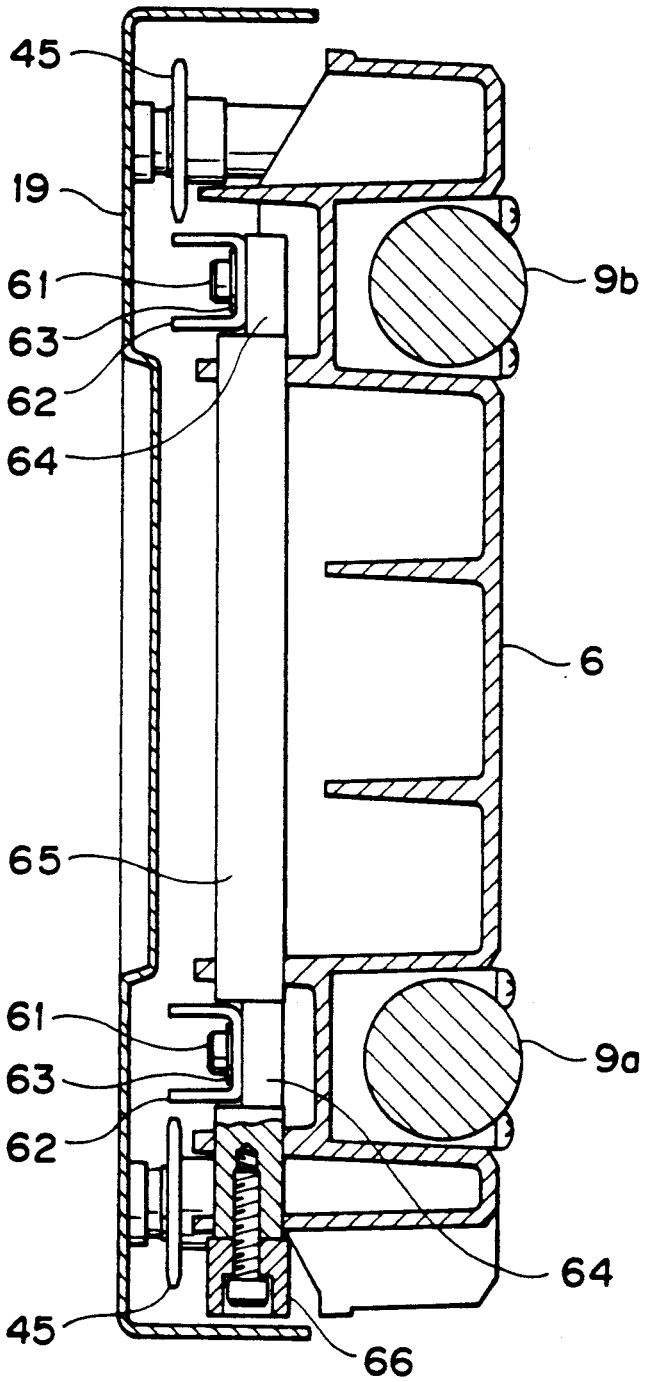
FIG. 11 is a view as viewed along the line XI—XI in FIG. 1.

In this manner, if a slide type of the operating 130 is used as shown in FIG. 12, the handle 131 thereof can be moved within a space smaller than that of the rotational handle 66 as shown in FIGS. 1 and 11. Further, in the case of the thickness determination work, the pressure rollers 9a, 9b can be adjusted so as to be located at a proper position projected from the guide surface $g_2$ of the movable stool 6, and, therefore, when the workpiece A is set in the machine, the pressure rollers 9a, 9b do not obstruct a smooth feeding of the workpiece A to increase accuracy of finishing.

The slide type of the operating plate 130 may be adapted for the change-over mechanism C as shown in FIGS. 4 to 6.

Figure 16:
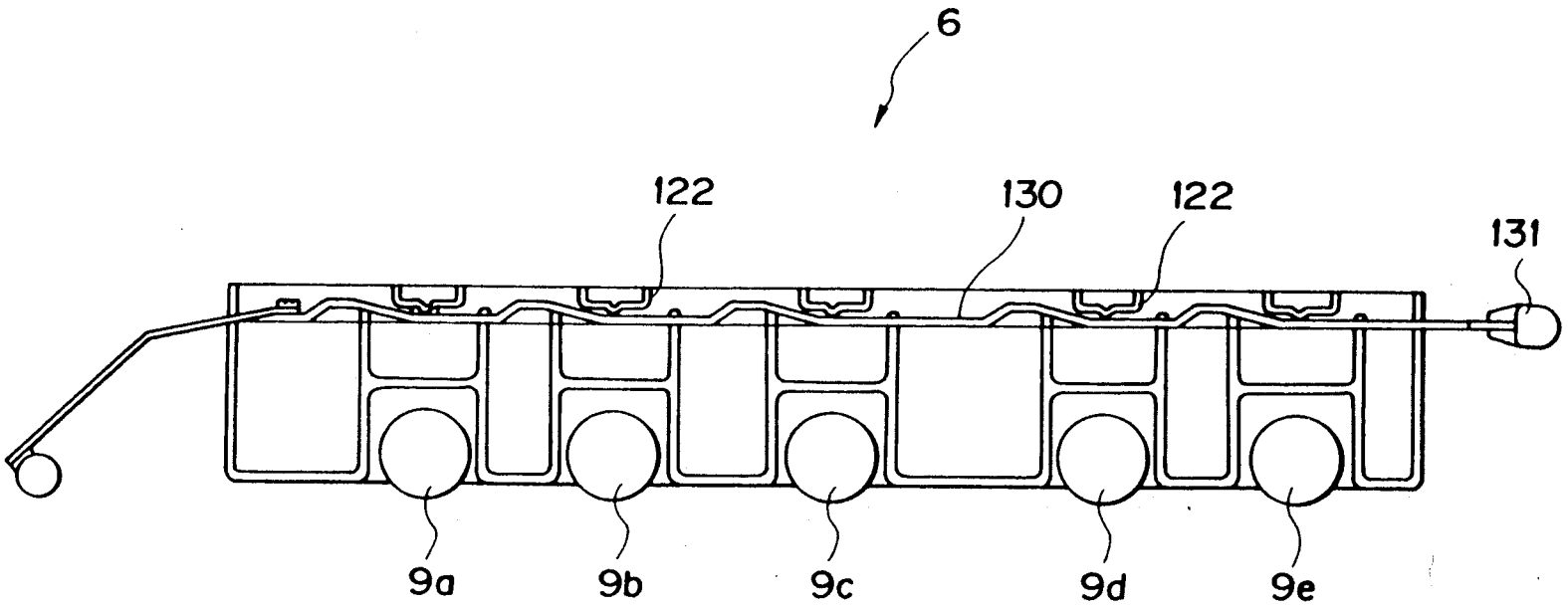
FIG. 16 is a plan view of a movable stool with a plurality of pressure rollers.
Figure 17:
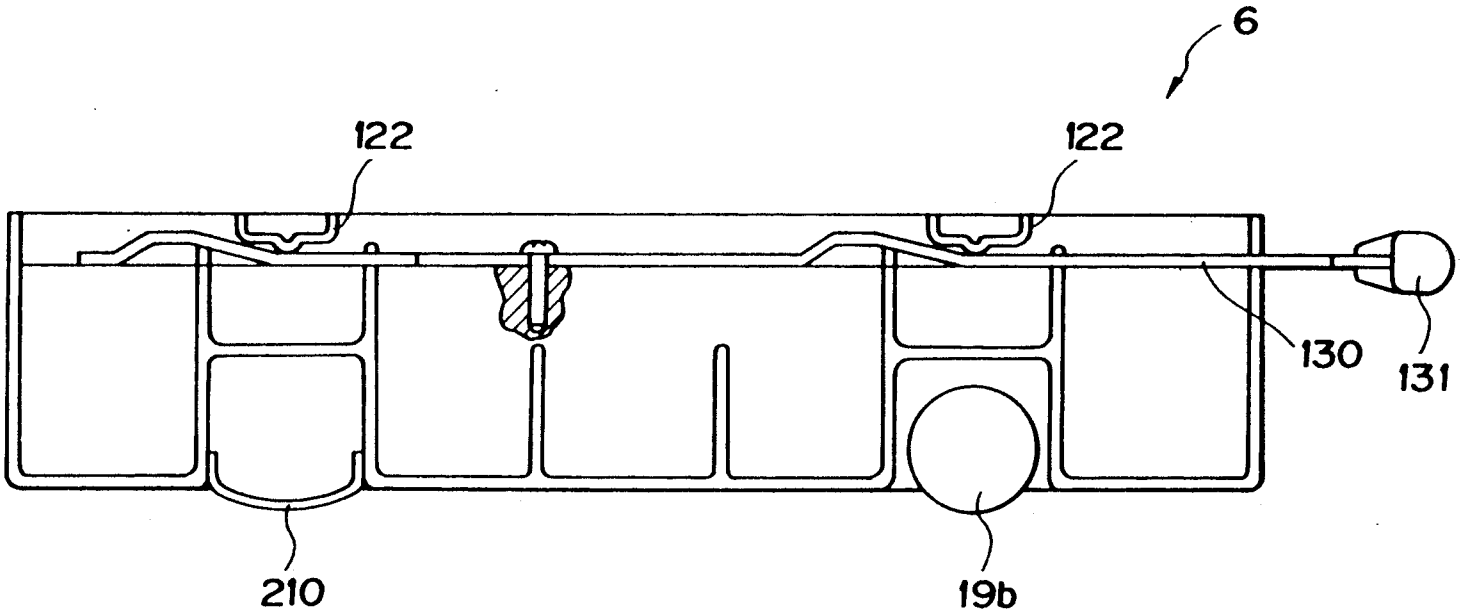
FIG. 17 is a plan view of a movable stool with one pressure plate.
Figure 18:
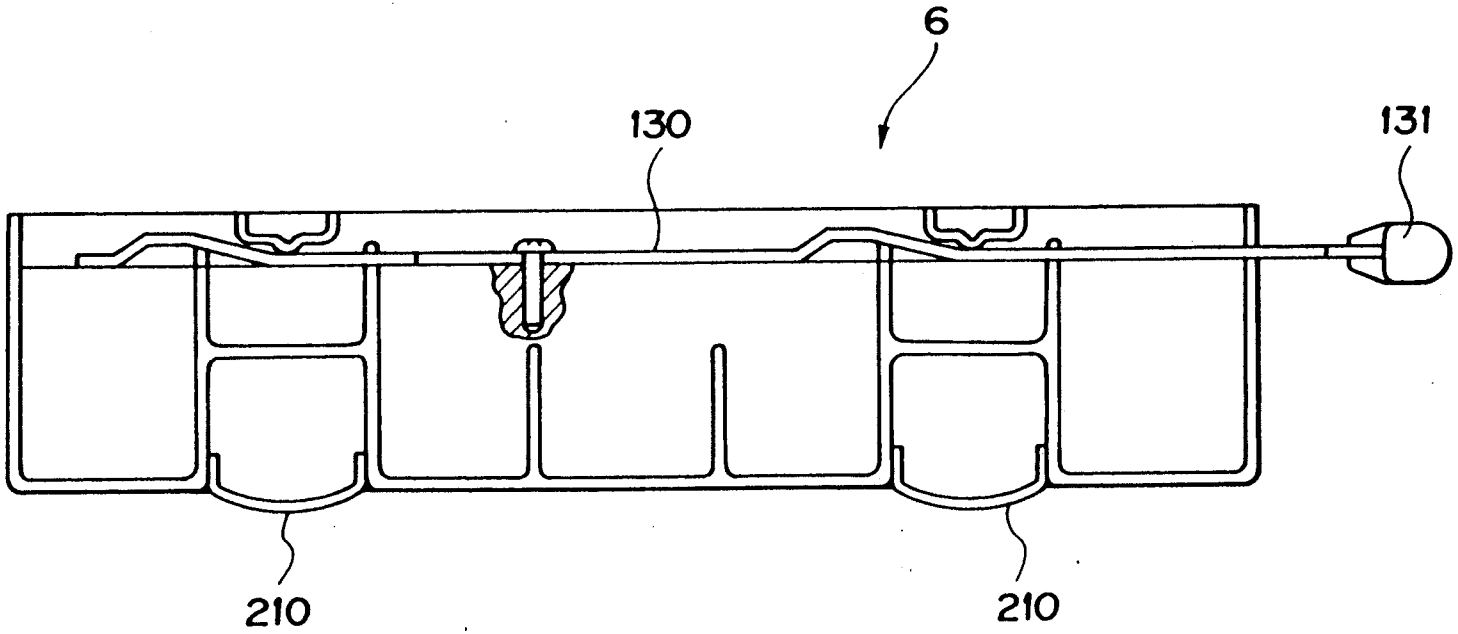
FIG. 18 is a plan view of a movable stool with two pressure plates.
Figure 19:
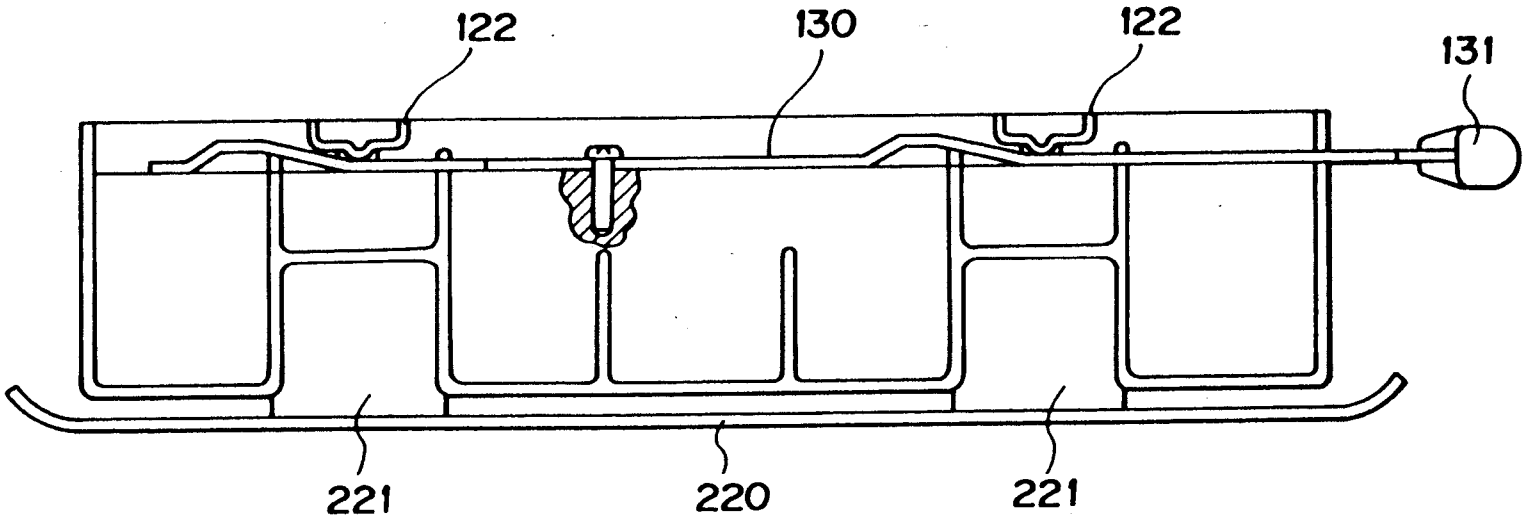
FIG. 19 is a plan view of a movable stool with a pressure wall plate for covering the total area of the guide surface of a movable stool.

FIG. 16 shows other embodiment of the movable stool 6, which has three or more, e.g. five pressure rollers 9a to 9e. In this manner, if a number of pressure rollers are provided on the movable stool 6, the workpiece A can be held at some positions which are not opposed to the two feed rollers 8a, 8b thereby to ensure reliably the function of the pressure rollers 9a, 9b to increase accuracy of finishing. Further, as shown in FIG. 17, there may be, as shown in FIG. 17, provided one pressure roller 19b and one pressure plate 210 provided with a pushing device. Instead of the two pressure plates 210, 210 may be provided, as shown in FIG. 19, a pushing wall plate 220 with a change-over mechanism C may be used for covering the total area of the guide surface $g_2$ of the movable stool 6 therewith. The pushing wall plate 220 make it possible that the workpiece A is pushed uniformly toward the stationary stool 5 in the case of the flat work to increase accuracy of the flat work.

In the above embodiments, the cutter block 7, the feed rollers 8a, 8b, pressure rollers 9a, 9b, etc. are disposed vertically and, however, those members may be disposed horizontally. The pushing devices P are provided on the movable stool 6, and, however, the pushing devices P may be provided on the stationary stool 5 together with the feed rollers 8a, 8b as indicated by dotted lines in FIG. 9. In this case, the feed rollers 8a, 8b functions also as the pressure rollers 9a, 9b in addition to its original function.

According to this invention, the both flat work and thickness determination work can be performed in the same place with respect to the cutter block 7, and, the workpiece A can be set in the machine M from the front thereof in both flat and thickness determination works. Accordingly, the machine M becomes compact. The flat work has been conventionally performed by hand, and, however, according to this invention, the flat work can be automatically performed, that is, the workpiece A can be automatically fed into the machine M during the flat work.

If each member is disposed vertically as shown in the drawings, the pressure force exerted on the workpiece A is not changed in accordance with the weight of the workpiece A. Therefore, accuracy of finishing is increased and the feeding of the workpiece A is reliably performed. If a number of pressure rollers, pressure plates or the like are used as pressure members for pushing the workpiece A, the pushing operation for the workpiece A is more reliably performed. Furthermore, if the pushing device is composed of the first and second springs, only the change-over operation of the second spring makes it possible that the flat and thickness determination works are changed over. As a result, the structure thereof is simple and the maintenance thereof can be carried out easily.

In addition, if the change-over mechanism is operated by the cams, the change-over operation can be performed speedily. If the operating plate is used for the change-over mechanism, a space for setting the operating plate becomes small. If the pressure and feed rollers are constructed in such a manner that the amount projected from the guide surfaces of their stools can be adjusted, and the pressure and feed rollers are retracted slightly from their normal positions into the movable stool, the feeding movement of the workpiece A is not obstructed. Finally, if the feed rollers are disposed obliquely, the workpiece A is pushed downwardly on the lower datum plane of the machine M to increase accuracy of finishing.

As many apparently widely different embodiments of this invention may be made without departing from the spring and scope thereof, it is to be understood that the invention is not limited to the specific embodiments thereof except as defined in the appended claims.

What is claimed is:

1. An automatic planing machine for cutting a workpiece flat, said planing machine comprising:

a) a cutter block for cutting the workpiece;

b) at least one flat work table provided beside the cutter block for performing a planing operation to cut a surface of the workpiece flat;

c) a thickness determination table provided opposite to the flat work table at a predetermined interval therefrom in order to cut the workpiece to a predetermined thickness, and d) pushing means for pushing the workpiece relative to the cutter block to perform a planing operation thereon.

2. An automatic planing machine according to claim 1, wherein the pushing means comprises at least one feed roller provided on a side of the cutter block for exerting a constant pressure force on the workpiece in order to feed the workpiece, at least one pressure member provided on the thickness determination table for holding the workpiece, cooperating together with the feed roller, and at least one pushing device for selectively exerting on the pressure member either a pressure force larger or smaller than a pressure force of the feed roller.

3. An automatic planing machine according to claim 1, wherein the pushing means comprises at least one feed roller provided beside the cutter block, and at least one pushing device for selectively exerting on the feed roller a pressure force for either surface planing or thickness planing.

4. An automatic planing machine according to claim 1, wherein the flat work table is stationary and the thickness determination table is movable toward and away therefrom.

5. An automatic planing machine according to claim 2, wherein the cutter block, the feed roller, the pressure member, the flat work table and the thickness determination table are disposed vertically.

6. An automatic planing machine according to claim 2, wherein the pressure member comprises a plurality of feed rollers.

7. An automatic planing machine according to claim 2. wherein the pressure member comprises a plurality of pressure plates.

8. An automatic planing machine according to claim 2, wherein the pressure member comprises a pressure wall plate for covering the total area of the thickness determination table.

9. An automatic planing machine according to claim 2, wherein the pushing device comprises a first spring for generating a first pressure force weaker than a constant pressure force by the feed roller, a second spring for generating a second pressure force, a total of the first and second pressure forces being larger than the constant pressure force by the feed roller, and a change-over mechanism for changing over a pressure force exerted on the pressure member by switching over exertion of the pressure force by the second spring.

10. An automatic planing machine according to claim 9, further comprising a change-over mechanism having a pushing pin engaging with a second spring and a cam pivotally provided on the thickness determination table for alternatively making the pushing pin contact the pressure member or separating the pin therefrom.

11. An automatic planing machine according to claim 9, wherein the change-over mechanism comprises a pushing rod engaging with the second spring, and a slide type of operating member for making the pushing rod contact the pressure member or separating the rod therefrom.

12. An automatic planing machine according to claim 11, wherein the change-over mechanism retracts slightly the pressure member into the thickness determination work stool when the pushing rod is separated from the pressure member.

13. An automatic planing machine according to claim 5, wherein the feed roller is inclined slightly with respect to a lower datum plane of the machine to push downwardly the work set in the machine to the datum plane.

* * * * *